United States Patent [19]

Guido

[11] 4,287,430

[45] Sep. 1, 1981

[54] COORDINATED CONTROL SYSTEM FOR AN ELECTRIC POWER PLANT

[75] Inventor: Paul V. Guido, Cedar Grove, N.J.

[73] Assignee: Foster Wheeler Energy Corporation, Livingston, N.J.

[21] Appl. No.: 113,165

[22] Filed: Jan. 18, 1980

[51] Int. Cl.[3] ..... F01K 13/02; F22D 5/26; H02P 9/04

[52] U.S. Cl. ..... 290/40 C; 60/646; 60/665

[58] Field of Search ..... 290/40 C, 40 R, 40 B, 290/40 F; 60/665, 646

[56] References Cited

U.S. PATENT DOCUMENTS

| | | | |
|---|---|---|---|
| 3,109,102 | 10/1963 | Jenkins | 290/40 R |
| 3,310,683 | 3/1967 | Hottenstine | 290/40 R |
| 3,338,053 | 8/1967 | Gorzegno et al. | 60/646 |
| 3,922,859 | 12/1975 | Durrant et al. | 60/665 |
| 3,954,087 | 5/1976 | Stevens et al. | 122/406 S |
| 4,068,475 | 1/1978 | Binstock | 60/665 |
| 4,241,585 | 12/1980 | Gorzegno | 60/646 |

*Primary Examiner*—J. V. Truhe
*Assistant Examiner*—Shelley Wade
*Attorney, Agent, or Firm*—Marvin A. Naigur; John E. Wilson; John J. Herguth, Jr.

[57] ABSTRACT

The operation of an electric power plant is controlled by generating a control signal in response to the pressure at the throttle valves, the load demand signal and the megawatt output of the power plant. During the start-up, before the pressure ramp ends, the control signal varies in accordance with the difference between the pressure at the throttle valves and the pressure required at the throttle valves to produce the load represented by the load demand signal and, after the pressure ramp ends, the control signal is varied in accordance with the difference between the load represented by the load demand signal and the megawatt output of the power plant. Integral separators are employed during start-up to separate the water from the steam and a bypass system is provided to collect the water from the separators and recirculate it. The firing rate of the furnace is controlled in accordance with the control signal. After the bypass system has gone out of service, the feedwater pump is controlled in accordance with the control signal. After the pressure ramp ends, the position of the throttle valves is controlled in accordance with the control signal.

3 Claims, 1 Drawing Figure

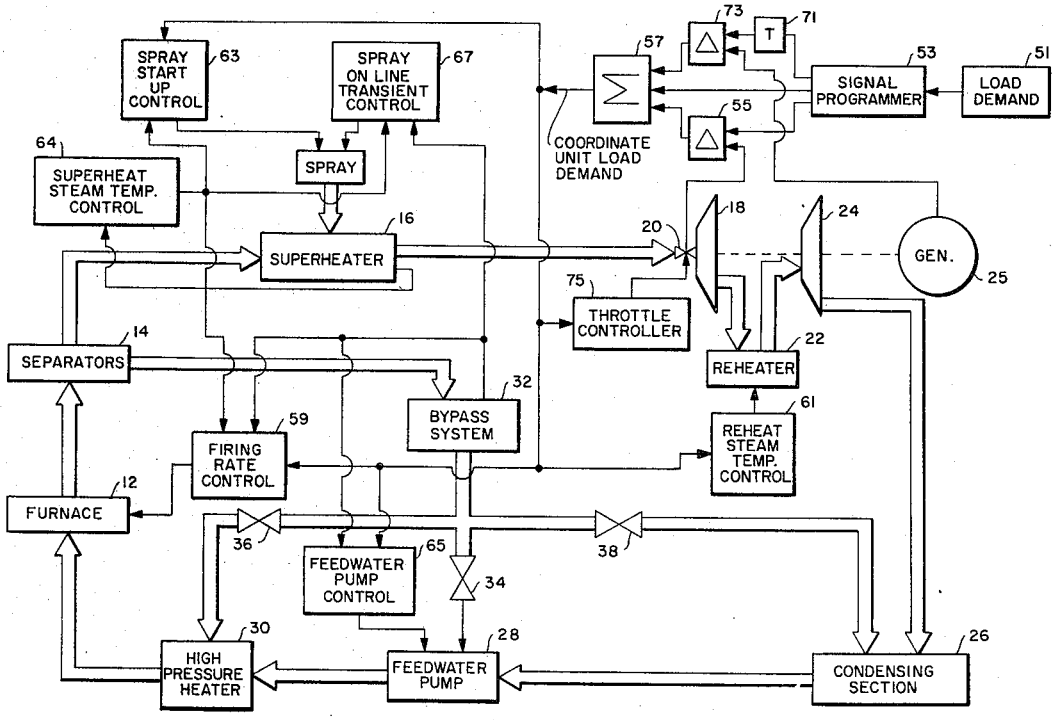

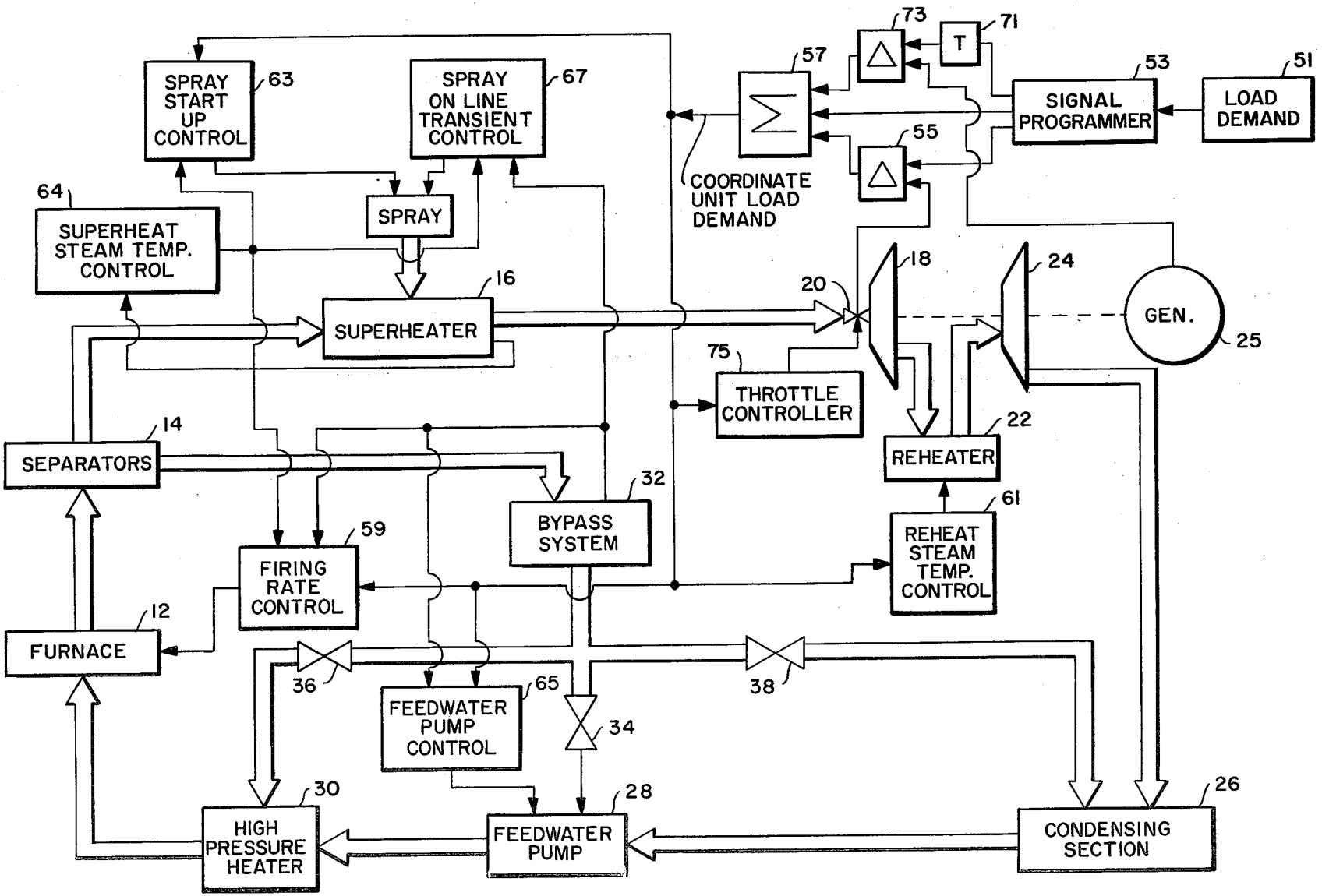
LOAD DEMAND
51
SIGNAL PROGRAMMER
53
GEN.
25
CONDENSING SECTION
26
24
22
REHEATER
61
REHEAT STEAM TEMP. CONTROL
71
T
73
55
18
20
THROTTLE CONTROLLER
75
57
COORDINATE UNIT LOAD DEMAND
38
32
BYPASS SYSTEM
34
28
FEEDWATER PUMP
65
FEEDWATER PUMP CONTROL
67
SPRAY ON LINE TRANSIENT CONTROL
16
SUPERHEATER
SPRAY
59
FIRING RATE CONTROL
36
30
HIGH PRESSURE HEATER
63
SPRAY START UP CONTROL
SUPERHEAT STEAM TEMP. CONTROL
64
14
SEPARATORS
12
FURNACE

COORDINATED CONTROL SYSTEM FOR AN ELECTRIC POWER PLANT

BACKGROUND OF THE INVENTION

This invention relates to electric power plants of the type employing fossil fuel fired steam generators and, more particularly, to a control system for such a power plant. In power plants employing fossil fuel fired steam generators, variable pressure operation at the turbine throttle, particularly for cycling service, is desirable to minimize steam temperature effects which could otherwise lead to turbine damage. In the past, steam generators for cycling service have been of the natural circulation type. However, the development of the integral steam separator has now made the once through supercritical steam generator also suitable for cycling service and variable pressure operation. The once through steam generator is normally arranged with a start-up bypass system designed to recirculate at low loads. It has been the practice on these units to operate at variable pressure and to come to full throttle pressure at 25 percent load at which point the bypass system was phased out of service. Recently, it has been proposed, in order to achieve maximum protection against turbine damage, to operate at variable throttle pressure up to a higher load by having some of the turbine throttle valves fully opened, for example, the first two for a four valve machine, so that 60 percent load is achieved at full throttle pressure. Alternatively, variable pressure can be carried to full load.

The control system of the present invention is designed to control the power plant employing a once-through steam generator in order to achieve variable pressure operation at the turbine throttle up to any selected load.

SUMMARY OF THE PRESENT INVENTION

The automatic control system of the present invention controls operation of the power plant after the system is warmed and the turbine has been rolled and synchronized with an initial load applied to the turbine. The automatic control system responds to the load demand signal and the pressure at the throttle to initially control the furnace firing rate and then when the bypass system is phased out of service to also control the feedwater pump to ramp the pressure at the throttle up to the set point at which the pressure ramp is designed to end. The system then controls the operation of the plant at loads above this set point by comparing the load demand signal with the megawatt output of the system and positions the turbine throttle valves and controls the furnace firing rate and the feedwater pump in accordance with the difference between the load demand signal and the megawatt output.

BRIEF DESCRIPTION OF THE DRAWINGS

The objects and advantages of the invention in addition to those evident from the background and summary of the invention described above will be more fully appreciated by reference to the following detailed description of a preferred and illustrative embodiment of the invention when taken in conjunction with the single FIG. of the drawing which illustrates a block diagram of the system of the present invention.

DESCRIPTION OF THE PREFERRED EMBODIMENTS

As shown in the block diagram of the drawings, a furnace 12 feeds steam and/or water to integral separators 14, which are connected to feed steam to a superheater 16. The superheater 16 feeds superheated steam to a high pressure turbine 18 through turbine throttle valves 29. The steam, after driving the turbine 18, flows to a reheater 22 where the steam is reheated and fed to a low pressure turbine 24. The turbines 18 and 24 are connected to drive a generator 25. The steam, after passing through and driving the low pressure turbine 24, is fed back to a condensing section 26, where the steam is condensed back to water and fed to a feedwater pump 28, which pumps the water at a high pressure to a high pressure heater 30. The high pressure heater 30 feeds water at an elevated temperature and pressure to the furnace 12, which converts the water to steam.

During start-up, the output from the furnace 12 to the separators 14 will be partly water and steam and the separators 14 separate the water from the steam so that only steam is fed to the superheater 16. The water separated out by the separators 14 is collected by a bypass system 32 and may be fed back to the feedwater pump 28 or high pressure heater 30 through valves 34 and 36. The water from the bypass system 32 may be also be fed back to the condenser section 26 for purposes of cycle water clean up. The portions of the system described thus far are referred to collectively as the plant, which is more fully described in U.S. Pat. No. 3,954,087.

Cold start up to warm the system and roll and synchronize the turbine is effected in a conventional manner as described in U.S. Pat. No. 3,954,087. After the turbine has been synchronized, the throttle pressure, which is the pressure at the throttle valves 20, would be typically 600 PSIG and the load on the generator would typically be 8 percent of capacity.

After the turbine has been synchronized, the coordinated control system of the present invention assumes control of the operation of the plant and will cause the throttle pressure to increase to maximum pressure of 3500 PSIG. The increase in throttle pressure during start up is referred to as the pressure ramp. Typically, the pressure ramp will end at a load of 60 percent of capacity. Alternatively, the throttle pressure may be varied to full load.

The coordinated control system controls the operation of the plant in response to a load demand signal, provided by a load demand signal source 51, the throttle pressure, and the megawatt output of the generator 25. The load demand signal provides an indication of what load is desired from the system. In start-up, after the turbine as been synchronized, this load demand signal would be at 8 percent of capacity. During start-up, the load demand signal is ramped from 8 percent to a selected load set point at which the pressure ramp is selected to end. In response to the ramping of the load demand signal from 8 percent of load to the set point at which the pressure ramp ends, the coordinated control system will cause the throttle pressure to ramp from 600 PSIG to 3500 PSIG. During this phase of the operation, the throttle valves 20 are set and will remain in a fixed position. For example, if the set point at which the pressure ramp ends is 60 percent load, then the first two valves in a four valve system would be opened. With the throttle valves in a fixed position, the load on the generator will be proportional to the throttle pressure at the throttle valves 20 and, as the pressure is ramped from 600 PSIG to 3500 PSIG, the generator load will increase from 8 percent to the set point at which the pressure ramp ends. The load demand signal from the source 51 is applied to a signal programer 53 which converts the applied signal to a pressure representing signal corresponding to the position at which the throttle valves 20 are set during the pressure ramp in the start-up operation. This signal is applied to a signal subtractor 55 which also receives a signal representing the throttle pressure at the turbine throttle valves 20. The signal subtractor 35 takes the difference between the two applied signals and applies this signal to a summing device 57. The output signal of the subtractor 55 will represent the difference between the throttle pressure needed to produce the desired load represented by the load demand signal and the actual throttle pressure at the turbine valves 20. The signal programmer 53 also generates a feed-forward signal which varies in accordance with the load demand signal according to a predetermined calibration. This feed-forward signal is applied to the summing circuit 57 and added to the output of the subtractor 55 to provide at the output of the summing circuit 57 a coordinated unit load demand signal. This coordinated unit load demand signal controls the operation of the plant to provide a genertor load corresponding to the load demand signal.

The coordinated unit load demand signal is applied to a firing rate control 59, which controls the fuel and air rate to the furnace 12. During the initial part of the pressure ramp, while the bypass system 32 is still in service, the firing rate control 59 will control the firing rate of the furnace directly in proportion to the coordinated unit load demand signal. Thus, as the coordinated unit load demand signal increases, the firing rate to the furnace 12 will increase and thus increase the steam pressure at the turbine throttle valves 20. Accordingly, as the load demand signal is ramped upwardly from 8 percent, the pressure at the throttle valves 20 will ramp upwardly and the generator load will increase.

The coordinated unit load demand signal is also applied to a reheat steam temperature control 61, which controls the gas proportion dampers in the reheater 22 in accordance with the coordinated unit load demand signal.

In addition, the coordinated unit load demand signal is applied to a spray start-up control 63 which also recieves a temperature control signal from a superheat temperature control 64. The superheat temperture control 64 receives signals from the superheater representing the interstage steam temperature and the final stage steam temperature. The temperature control signal is derived from the two applied signals so that if either the interstage steam temperature in the superheater or the final stage steam temperature increases, it will be reflected in the temperature control signal. The spray start-up control controls the spray applied to the superheater 16 in accordance with the coordinated unit load demand signal as compared with the temperature control signal.

When the load on the generator reaches about 25 percent of capacity, all of the output from the furnace 12 will be steam so that the bypass system 32 for collecting the water separated out from the steam by the separators 14 will no longer be needed. Accordingly, at about 25 percent of load, the bypass system 32 automatically goes out of service in response to the pressure at the output of the separators 14 reaching a predetermined pressure corresponding to the output of the furnace 12 being all steam. The load set point at which the bypass system goes out of service can be varied. When the bypass system 32 goes out of service, it signals the firing rate control 59, a feedwater pump control 65 and the spray on-line transient control 67. After the bypass system 32 has gone of service, the firing rate control 59 will continue to control the rate of fuel and air to the furnace 12 in accordance with the coordinated unit load demand signal, but, in response to receiving the signal from the bypass system 32 indicating that the bypass system is out of service, the firing rate will be modified in accordance with the temperature control signal received from the superheat steam temperature control 64 as determined by the interstage steam temperature and the final temperature of the superheater 16. After the bypass system 32 has gone out of service, the firing rate control 59 will respond to changes in the temperature control signal to reduce the fuel and air rate to the furnace 12 to counteract increases in the interstage temperature of final stage temperature of the superheater.

During the initial part of the pressure ramp before the bypass system 32 goes out of service, the feedwater pump 28 will pump water at about 25 percent of capacity. After the bypass system 32 goes out of service, the feedwater pump control 65, in response to the signal received from the bypass system 32, will begin to control the feedwater pump to pump water in direct proportion to the coordinated unit load demand signal so that as the firing rate of the furnace 12 is increased to enable it to generate more steam, the feedwater pump 20 will pump more water to the furnace to furnish a supply of feedwater for the increased steam.

After the bypass system 32 goes out of service, the spray on-line transient control 67 begins to control the spray in the superheater 16 in response to the temperature control signal output from the super heat steam temperature control 64.

As the load demand signal continues to ramp upwardly from 25 percent toward the set point at which the pressure ramp ends, the firing rate and the feedwater pump rate will be correspondingly increased in response to the increasing coordinated unit load demand signal from the summing circuit 57. In addition, the reheat temperature control 61 continues to control the gas dampers in the reheater 22 in accordance with the applied control signal.

The signal programmer 53 also applies a signal corresponding to the load demand signal to a transfer circuit 71. When the load demand signal reaches the set point at which the pressure ramp is selected to end, the transfer circuit 71 will apply the signal to a subtractor 73, which also receives a signal representing the megawatt output from the generator 25. When the load demand signal rises above the value at which the pressure ramp is selected to end, the subtractor 73 will be enabled to produce a signal representing the difference between the load represented by the load demand signal and the actual load on the generator 25 as represented by the megawatt output of the generator. The summing circuit 57 will then add this signal to the feed-forward signal produced by the subtractor 55. As the load demand signal increases above the load at which the pressure ramp is selected to end, the signal programmer 53 will continue to apply a constant signal to the subtractor 55 corresponding to the maximum pressure of 3500 PSIG. When the pressure ramp ends, the pressure at the throttle valves 20 should have been increased to 3500 PSIG, so the output from the subtractor 55 should be zero for load demand signals above that at which the pressure ramp ends. Accordingly, the coordinated unit load demand signal produced by the summing circuit 57 will correspond to the difference between the load demand signal and the actual load on the generator 25 added to the calibrated feed-forward signal applied to the summing circuit 57 from the signal programmer 53 and modified by any small difference signal being produced by the subtractor 55.

The firing rate control 59 will continue to control the firing rate of the furnace 12 and the feed-water pump control 65 will continue to control the feed-water pump 28 as the load demand varies above the set pont at which the pressure ramp ends in the same manner as described above. In addition, the reheat temperature control 61 will control the dampers in the reheaters 22 in response to the coordinated unit load demand signal.

The coordinated unit load demand signal produced by the summing circuit 57 is also applied to a throttle controller 75 which comes into operation in response to the coordinated unit load demand signal rising above the set pont at which the pressure ramp is selected to end. Until the coordinated unit load demand signal reaches this set point, the throttle controller 75 will maintain the throttle valves 20 in the fixed position. But when the coordinated unit load demand signal rises above the set point at which the pressure ramp is selected to end, the throttle controller 75 will begin to control the position of the throttle valves 20 in accordance with the coordinated unit load demand signal and will open the throttle valves in accordance with the increase in the signal above the set point. In this manner, the generator load will be increased with further increases in the coordinated unit load demand signal after the pressure ramp ends.

Variations in the coordinated unit load demand signal in either direction above the set point at which the pressure ramp ends will cause corresponding changes in the firing rate, the feedwater rate, the turbine throttle valve position, and the gas proportion dampers to change the generator load to correspond to the coordinated unit load demand signal.

The control system described thus provides an automatic control of the power plant both during the pressure ramp up to a set point at which the pressure ramp ends and at loads above this set point.

We claim:

1. In a power plant having a steam turbine driving a generator, a furnace for generating steam to drive the turbine, separators to separate the water from the steam in the output of the furnace, a feedwater pump to pump water to said furnace, and a bypass system to collect the water separated out by said separators and recirculate the water to said furnace, said bypass system operating during start-up to a predetermined load set point and going out of service when the load rises above said predetermined set point; the improvement comprising: means to provide a load demand signal, means to provide a signal representing the pressure at the throttle valves of said steam turbine, control signal generating means operating to provide a signal varying in accordance with the difference between the pressure at said throttle valves and the pressure required at said throttle valves to provide the load represented by said load demand signal with the turbine valves at a predetermined start-up position, means responsive to said control signal to control the firing rate of said furnace in accordance with said control signal, and means responsive to said control signal to control said feedwater pump to pump water to said furnace at a rate corresponding to said control signal only after said bypass system is out of service.

2. In a power plant as recited in claim 1, wherein said means to generate said control signal varies said control signal in accordance with the difference between the pressure at said throttle valves and the pressure required at said throttle valves to provide a load corresponding to said load demand signal only until the load reaches a second predetermined set point at which the pressure ramp is selected to end and varies said control signal at loads above said second predetermined set point in accordance with the difference between the laod represented by said load demand signal and the output of said generator; and wherein there is provided means to control the position of said throttle valves in accordance with said control signal at loads above said second predetermined set point.

3. In a power plant having a steam turbine driving a generator, a furnace for generating steam to drive said turbine, the improvement comprising means to provide a load demand signal, means to provide a signal representing steam pressure at the throttle valves of said turbine, means to generate a signal representing the megawatt output of said generator, means responsive to said load demand signal, and pressure representing signal and said signal representing the megawatt output of said generator to generate a control signal which varies in accordance with the difference between the pressure at said throttle valves and the pressure required at said throttle valves to provide a load corresponding to said load demand signal only while the load on said generator is below a predetermined set point at which the pressure ramp at said throttle valves is selected to end and to vary said control signal in accordance with the difference between the load represented by said load demand signal and the megawatt output of said generator at loads above said predetermined set point, means to control the firing rate of said furnace in accordance with said control signal, and means to control the position of said throttle valves in accordance with said control signal at loads above said predetermined set point.

* * * * *